US005572192A

United States Patent [19]

Berube

[11] Patent Number: 5,572,192

[45] Date of Patent: Nov. 5, 1996

[54] PERSONAL SECURITY SYSTEM WITH GUARD TOUR FEATURES

[75] Inventor: James E. Berube, Farmington, N.Y.

[73] Assignee: Detection Systems, Inc., Fairport, N.Y.

[21] Appl. No.: 214,276

[22] Filed: Mar. 17, 1994

[51] Int. Cl.[6] ..... G08B 13/00

[52] U.S. Cl. ..... 340/574; 340/306; 340/539

[58] Field of Search ..... 340/573–74, 311.1, 340/825.44, 539, 825.49, 306, 305, 287; 379/49; 455/88–90, 95, 49.1, 53.1

[56] References Cited

U.S. PATENT DOCUMENTS

| | | | |
|---|---|---|---|
| 2,298,840 | 10/1942 | Purcell | 340/306 |
| 3,573,620 | 4/1971 | Ashley et al. | 340/306 X |
| 4,611,198 | 9/1986 | Levinson et al. | 340/539 |
| 4,630,035 | 12/1986 | Stahl et al. | 340/539 |
| 4,672,654 | 6/1987 | Vanacore | 379/49 |
| 4,694,282 | 9/1987 | Tamura et al. | 340/539 |
| 4,764,757 | 8/1988 | DeMarco et al. | 340/574 |
| 4,908,602 | 3/1990 | Reich et al. | 340/514 |
| 4,990,892 | 2/1991 | Guest et al. | 340/573 |
| 4,998,095 | 3/1991 | Shields | 340/574 |
| 5,115,224 | 5/1992 | Kostusiak et al. | 340/574 |
| 5,223,816 | 6/1993 | Levinson et al. | 340/539 |
| 5,365,217 | 11/1994 | Toner | 340/539 |
| 5,416,466 | 5/1995 | Malvaso et al. | 340/539 |
| 5,416,468 | 5/1995 | Baumann | 340/573 |
| 5,467,074 | 11/1995 | Pedtke | 340/539 |

FOREIGN PATENT DOCUMENTS

| | | | |
|---|---|---|---|
| 2433795 | 4/1980 | France | 340/574 |

OTHER PUBLICATIONS

R. Petersen, "Hasler Personnel Protection Systems", *Hasler Review*, vol. 14, No. 4, pp. 122–127, 1981.

*Primary Examiner*—Thomas Mullen
*Attorney, Agent, or Firm*—J. Addison Mathews

[57] ABSTRACT

A personal security system including features for monitoring guard tours and other surveillance by security personnel. The security system includes a plurality of hand-portable transmitters, a plurality of fixed receivers and a control station. The transmitters are actuated to emit radio frequency signals including a class code that identifies first and second sets of the transmitters. The first set is assigned to security personnel and the second set to system subscribers. The receivers decode the signals from the transmitters and provide an output representing the receiver and the received class code. The control station identifies the location of the transmission using information from the receiver output, and records the time of the transmission. If the class code represents a security-assigned transmitter, the control station reports the information as a security function, such as a guard tour. If the class code represents a subscriber, the control station initiates actions appropriate for a subscriber transmission.

4 Claims, 8 Drawing Sheets

PERSONAL SECURITY SYSTEM WITH GUARD TOUR FEATURES

CROSS-REFERENCE TO RELATED APPLICATIONS

Reference is made to commonly-assigned, U.S. patent application Ser. No. 08/126,841, now U.S. Pat. No. 5,467,074, entitled PERSONAL SECURITY SYSTEM WITH TRANSMITTER TEST MODE, filed Sep. 20, 1993 in the name of D. Pedtke, the disclosure of which hereby is incorporated into the present specification.

BACKGROUND OF THE INVENTION

1. Field of Invention

The invention relates to personal security systems for emitting and locating emergency radio-frequency transmissions, and more specifically to such systems including features for monitoring security routes such as guard tours.

2. Description of the Prior Art

Personal security systems of the type most pertinent to the present invention include portable radio-frequency transmitters carried by a system subscriber for actuation in emergency or threatening situations. Fixed receivers monitor the area where the system is installed and initiate a planned sequence of events when an emergency transmission is detected. Sirens and strobes may be energized to scare away attackers, and appropriate security personnel may be called to provide assistance. The system usually is monitored from a control station having a program that uses the known positions of the signal-detecting receivers to identify the approximate location of the threatened subscriber. Examples are disclosed in Shields U.S. Pat. No. 4,998,095, issued Mar. 5, 1991; DeMarco U.S. Pat. No. 4,764,757, issued Aug. 16, 1988; and Levinson U.S. Pat. No. 4,611,198, issued Sep. 9, 1986. An improved approach for more precisely locating the transmission is disclosed in Kostusiak et al. U.S. Pat. No. 5,115,224, issued May 19, 1992. In addition to the known positions of the monitoring receivers, Kostusiak et al. use the relative strengths of the signals compared between several receivers.

Personal security systems that include guard tour features are not common. Some examples exist where private branch exchanges (PBX), including many different types of communications devices, are provided with features for use by security personnel. Vanacore U.S. Pat. No. 4,672,654, issued Jun. 9, 1987, is one such example that discloses a PBX system with algorithms for monitoring guard tours.

PROBLEM SOLVED BY THE INVENTION

Existing approaches for monitoring guard tours usually are independent, single purpose systems used only by security personnel. System cost, a major concern, is covered entirely by already strained security budgets. Many of the more sophisticated techniques are expensive to install and seldom approved.

Most tour monitors require inconvenient or time consuming actions by the guard at fixed stations. Sometimes keys are positioned at the desired check points for actuating a watchman's clock. Other approaches use cards including bar codes or magnetic information inserted into corresponding reading equipment. Still other examples use telephones or similar communications devices operated manually or by physical interaction with devices carried by the guard. In all systems of this type the guard must stop at each station long enough to operate the recording or communicating equipment. Although the time and effort may be small at each station, it adds up over long and multiple tours. Since the guard must interact physically with the equipment, it is accessible to tampering and vandalism.

Inflexibility is another disadvantage with most existing equipment. Changes in routes or the desired information may require equipment alterations involving many separate devices, either at the fixed stations or carried by the guards.

SUMMARY OF THE INVENTION

The present invention is directed to overcoming one or more of the problems set forth above. Briefly summarized, a personal security system is provided with features for monitoring guard tours and other surveillance by security personnel. According to one aspect of the invention, the security system includes a plurality of hand-portable transmitters, a plurality of fixed receivers and a control station. The transmitters are actuated to emit radio frequency signals including a class code that identifies first and second sets of the transmitters. The first set is assigned to security personnel and the second set to system subscribers or other non-security personnel. The receivers decode the signals from the transmitters and provide an output representing the receiver and the received class code. The control station identifies the location of the transmission using information from the receiver output, and records the time of the transmission. If the class code represents a security assigned transmitter, the control station reports the information as a security function, such as a guard tour. If the class code represents a subscriber, the control station initiates actions appropriate for a subscriber transmission.

According to more specific aspects of the invention, the transmitter signals further include a fixed code unique to the transmitter, and a selectable code identifying the type of transmission or event. Subscriber assigned types represent alarm and test events. Security assigned types represent modified alarm and location events. The location events are used for monitoring guard tours and similar security surveillance. The control station uses the unique codes to identify the individual, and the selectable code to identify the event.

According to still other features of the invention, the transmitters in both sets emit signals having the same characteristics, such as frequency and signal strength. The receivers determine the received signal strength, and the control station uses the received signal strength to assist in its functions. When the transmission is an alarm from a subscriber, the received signal strength is used in locating the transmission. When the transmission is part of a guard tour, for example, only signals above a threshold near the top of the potential range are recognized as valid, thus pinpointing the location of the guard adjacent the identified receiver.

ADVANTAGEOUS EFFECTS OF THE INVENTION

The invention uses the same equipment that is part of a personal security system for subscribers. The security functions are implemented through minor modifications easily made with switches and instruction sets. The cost of the system is shared by several functions, permitting more sophisticated security features with little increase in cost. For similar reasons, the system is flexible and easily modified to accommodate individual installments and requirements.

Since the fixed stations are activated by radio transmissions, the equipment can be placed high, out of reach by those who might tamper or attempt to defeat the system.

These and other features and advantages of the invention will be more clearly understood and appreciated from a review of the following detailed description of the preferred embodiment and appended claims, and by reference to the accompanying drawings.

DESCRIPTION OF THE PREFERRED EMBODIMENTS

Overview

Figure 1:
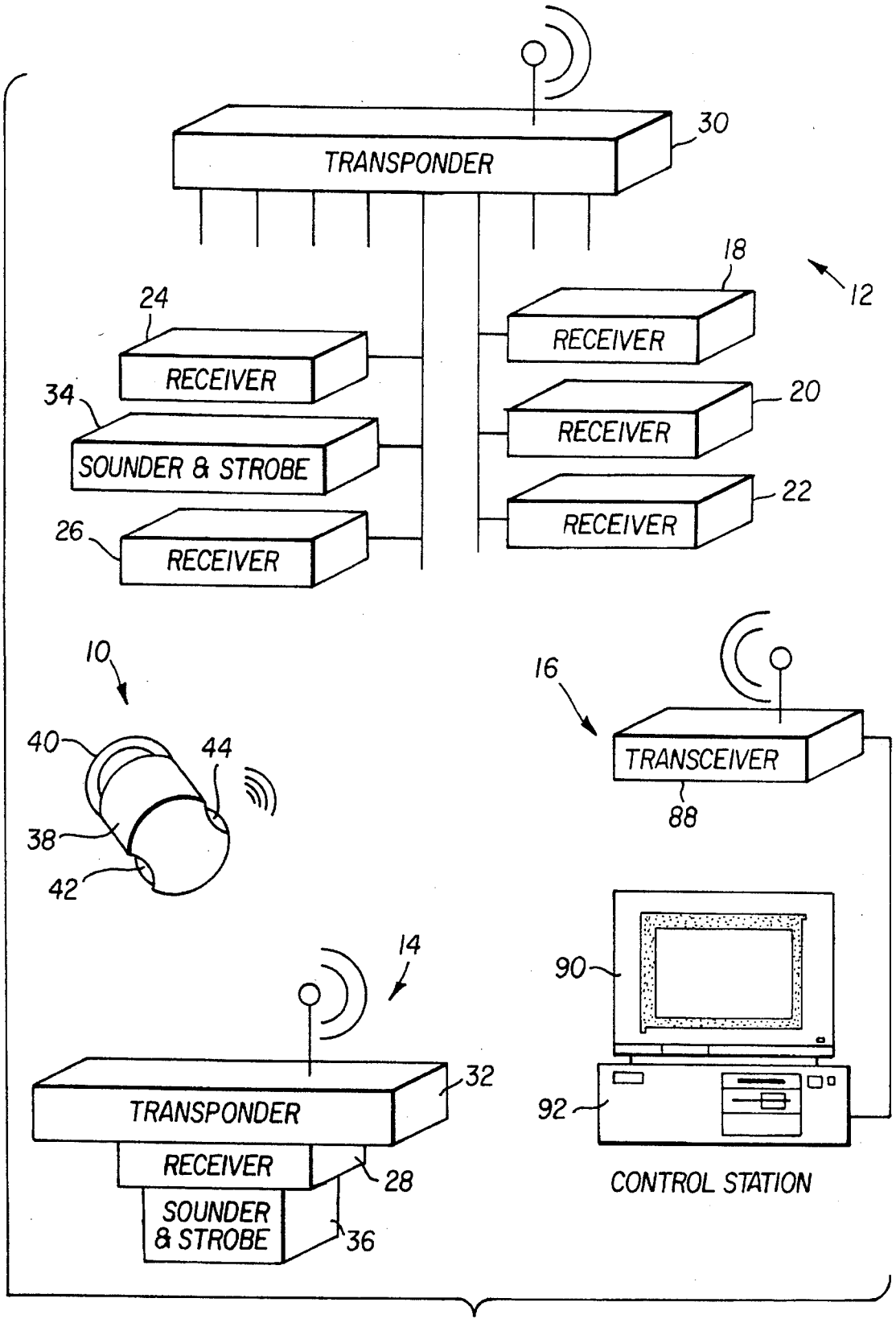
FIG. 1 is a schematic view of a personal security system including radio frequency transmitters, receivers and a control station, according to a preferred embodiment of the invention.
Figure 2:
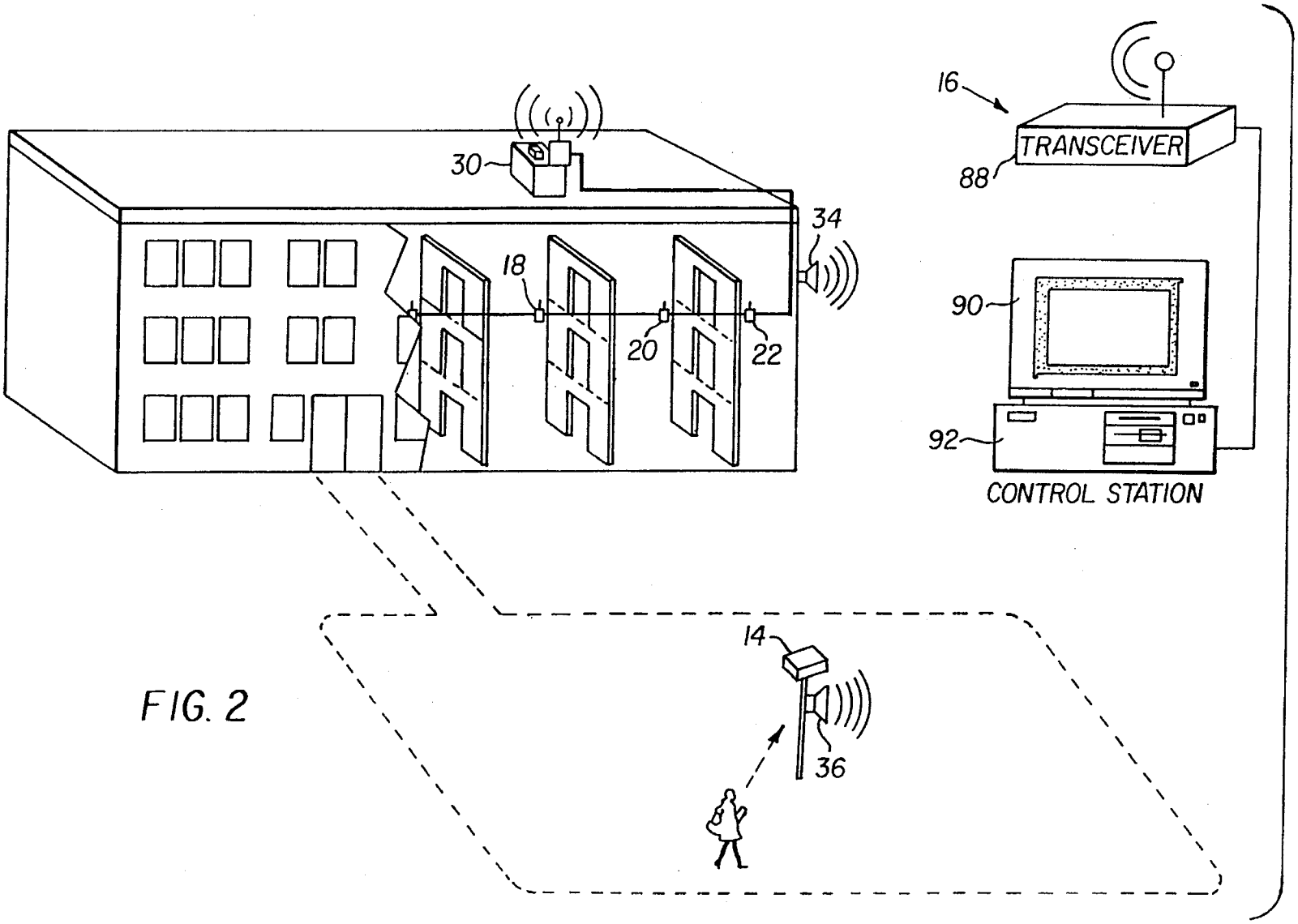
FIG. 2 is a schematic representation of an area, such as a campus, including an installed system of the FIG. 1 receivers and control station.

Referring now to FIGS. 1 and 2, a preferred embodiment of the invention is depicted in a personal security system including hand-portable transmitters 10, different combinations 12 and 14 of fixed receivers and transponders, and a control station 16.

The transmitters 10 are carried by subscribers to the system for actuation to scare attackers and call for help in emergency or threatening situations. The transmitters send a radio frequency signal to the surrounding area, at a predetermined frequency and signal strength, including a unique code that identifies the transmitter.

Essentially the same transmitters also are used by security personnel to report their positions on guard tours or other security surveillance. A class code is included in the transmitted signal to distinguish a first set of transmitters assigned to security personnel from a second set of transmitters assigned to subscribers.

Receivers 18, 20, 22, 24, 26 and 28 monitor the protected area for transmissions and, in combination with transponders 30 and 32 and control station 16, initiate a series of events appropriate for the indicated situation. The receivers detect, decode and store information about the signal, including received signal strength and identification of the transmitter. The control station then combines the signal information with a unique receiver identification to determine the location of the transmission and the name of the individual to which the transmitter is assigned. If the transmission indicates a subscriber emergency, sounders and strobes 34 and 36 are activated to sound an alarm in the vicinity of the transmission, and security personnel are dispatched to the same area for assistance. If the transmission is part of a guard tour, appropriate reports and actions are initiated to monitor the tour.

Transmitter and Transmitted Signal

The hand-portable transmitter 10, most clearly shown in FIGS. 1, 3, 4 and 6, is battery powered and adapted for convenient carrying in a purse or pocket. It is enclosed in a plastic case 38 including a key ring 40 and two switches depicted as depressable buttons 42 and 44. The switches are designed for actuation from opposite sides of the case against a spring bias and in a sequence that normally prevents accidental operation.

The switches 42 and 44 initiate operation of the transmitter, either in an alarm state or a test state, depending on the sequence of actuation. In both cases, alarm or test, the transmitter produces and transmits a radio frequency signal to the local geographic area at a predetermined frequency and signal strength. The frequency may be in the three hundred or nine hundred megahertz range typical for such applications. The signal strength is chosen in combination with the number and locations of the fixed receivers 16 so more than one and preferably at least three receivers typically will be able to identify and interpret the transmitted signal for the purposes to be described. At the same time, the signal strength, which falls off with the inverse square of the distance, should be weak enough to facilitate the location of the transmission based on differences in the signal strength at the detecting receivers.

Figure 3:
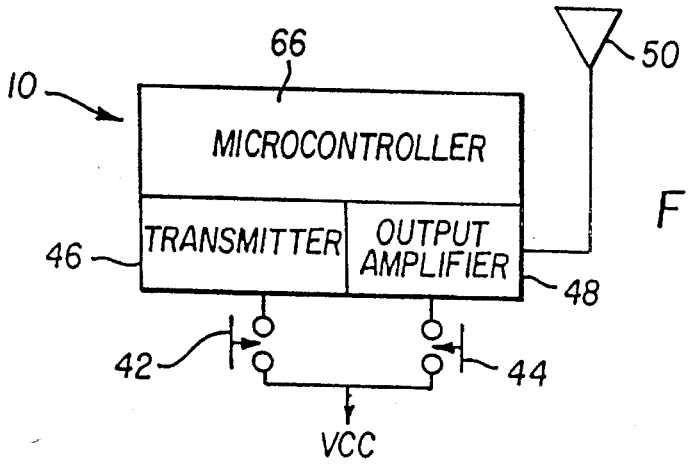
FIG. 3 is a schematic representation of a portable radio frequency transmitter for use with the preferred embodiment of FIG. 1.
Figure 4:
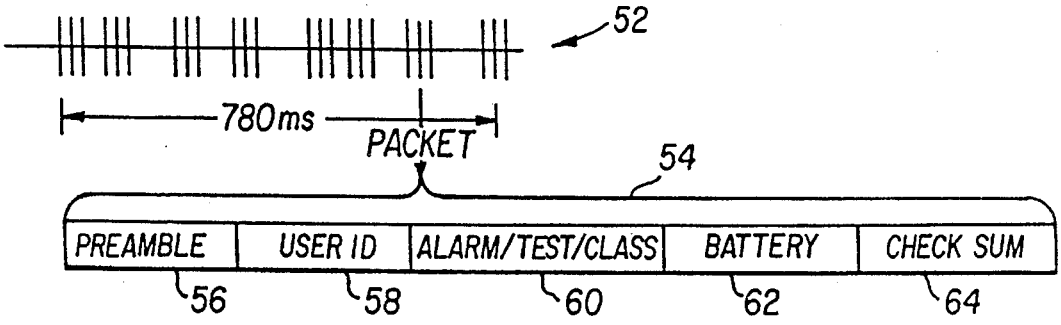
FIG. 4 is a schematic representation of the radio frequency signal from the transmitter of FIG. 3.

Referring now to FIGS. 3 and 4, actuation of the transmitter in either an alarm or a test mode broadcasts, or more accurately narrowcasts, a signal to the local geographic area through transmitter 46, output amplifier 48 and antenna 50. The signal includes a series of eight identical packets of information 52, having an irregular spacing to reduce the risk of jamming with other possible transmissions. The series of eight may be repeated several times at spaced intervals to take advantage of changing conditions, such as normal hand movement, that change the orientation of the transmitter antenna. The packets each contain the information identified at 54, including a preamble 56, a user or transmitter unique identification (ID) code 58, an alarm or test and class code 60, a low-battery warning set bit 62, and a check sum 64 for error detection. The portable transmitter and its various functions operate under the control of a microcontroller 66 which includes associated memory and appropriate timers (not separately shown).

The unique transmitter identification code is programmed and stored in memory, either at the time of manufacture or when the user subscribes to the system. The alarm or test and class code is set in part when the transmitter is manufactured, for either a subscriber, maintenance personnel or security personnel, and in part by the manner in which switches 42 and 44 are actuated. Simultaneous actuation of the switches 42 and 44 sets the code to indicate an alarm. Sequential actuation of the switches 42 and 44 sets the code to indicate a test. The code is three bits long, providing for eight possible settings, of which six are used. Settings pertinent to the present application include a subscriber alarm or test and a security alarm or test, again depending on the assignment and switch actuation.

The test or alarm and class code essentially segments the transmitters into two sets. A first or security set, and a second or subscriber set. A third set may be provided for maintenance personnel, but is not part of this description. With the exception of the codes, both sets are identical, including the same transmitter 46, amplifier 48, microcontroller 66 and antenna 50. Both sets have the same transmission characteristics, including frequency and signal strength, and both sets can be actuated in a first state representing an alarm or a second state representing a test or other non-alarm condition.

Figure 6A:
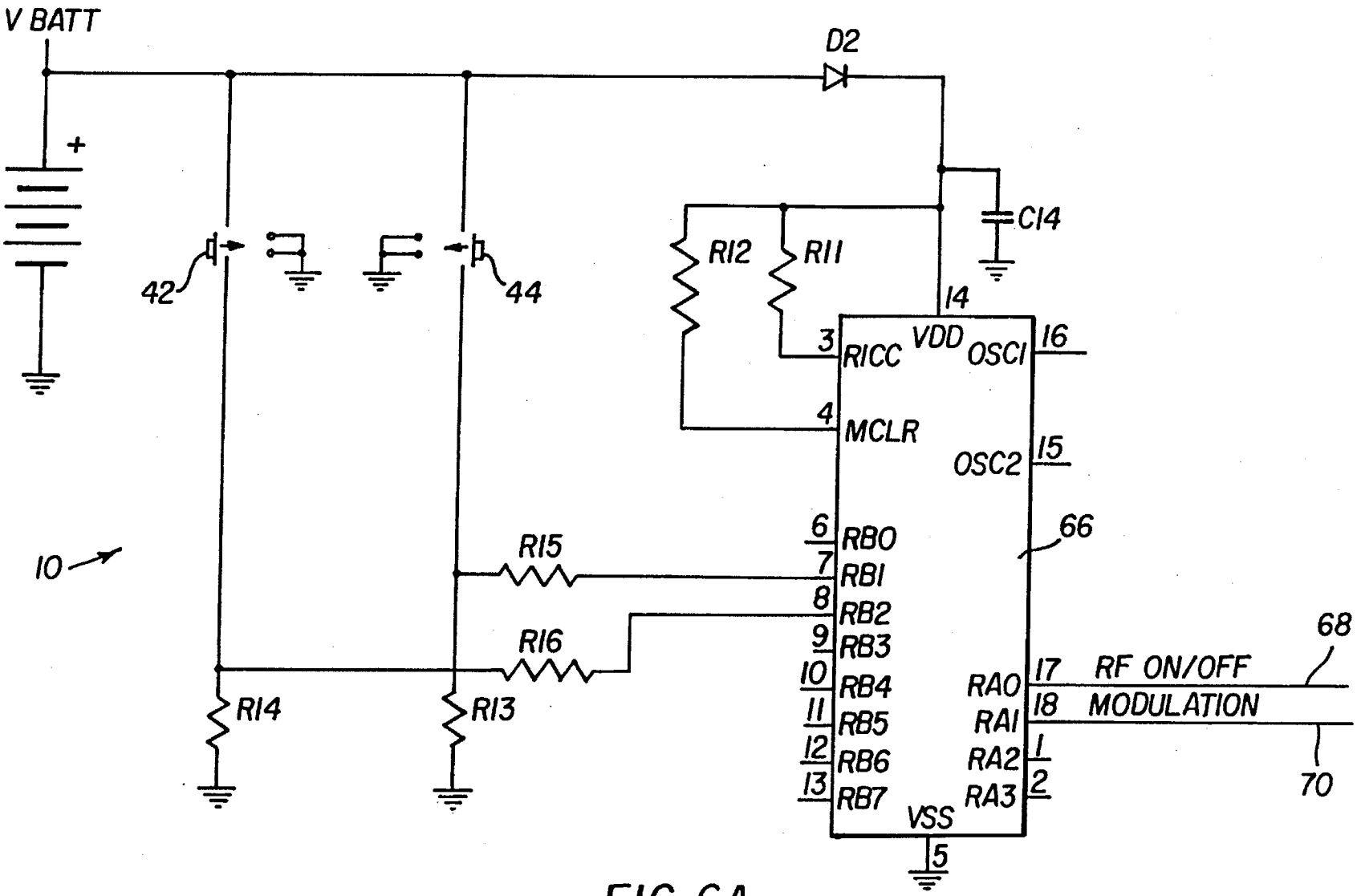
FIGS. 6A and 6B are schematic circuit diagrams of the transmitter of FIG. 3.
Figure 6B:
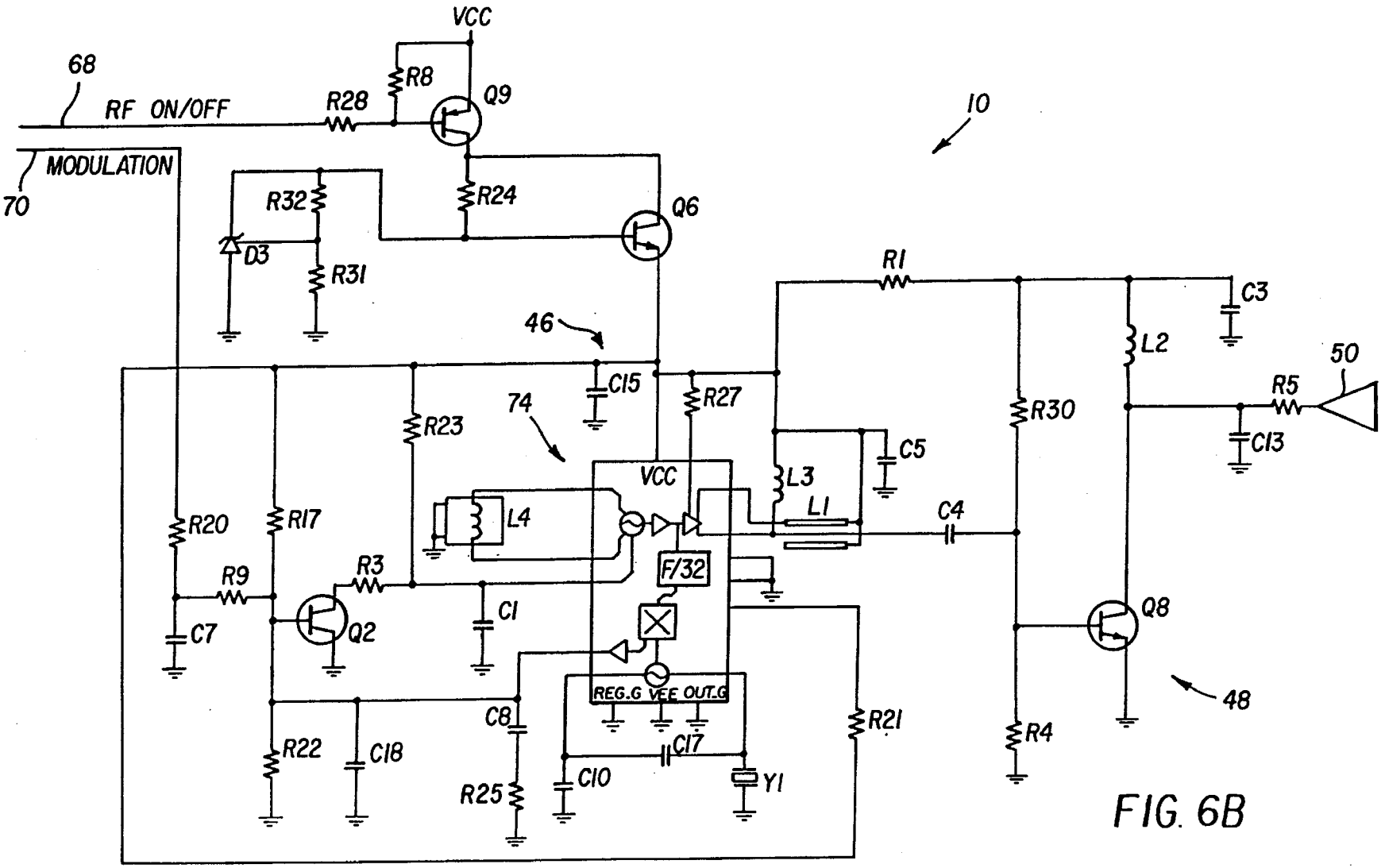

The transmitter circuit is illustrated in FIGS. 6A and 6B. FIG. 6A shows the switches 42 and 44 that operate in conjunction with timers and memory in the microcontroller 66. When an alarm or test is properly initiated, the microcontroller 66 sends first and second outputs 68 and 70 to transmitter 46 (FIG. 6B). Output 68 turns the transmitter on, while output 70 carries the information to be included in the transmitted signal, most notably the test or alarm and class code and the identification of the transmitter. FIG. 6B depicts a voltage regulating circuit 72, the transmitter 46, including internal oscillator 74, amplifier 48 and antenna 50.

Receivers and Transponders

The fixed receivers in this preferred embodiment are coupled to transponders in two different combinations 12 and 14 (FIG. 1). The combination depicted at 14 is preferred for outdoor use and includes a receiver 28, transponder 32 and sounder 36. The receiver, transponder and sounder are collocated and coupled with appropriate logic in a single weatherproof container. The receiver is positioned for good radio reception from the surrounding area, and is provided with appropriate antennas for monitoring the transmitters 10 and 68, and for communicating with the control station 16.

The other combination 12 includes several receivers 18, 20, 22, 24, and 26, multiplexed to one transponder 30, again with appropriate logic and one or more sounders and strobes 34.

The receivers are tuned to continuously monitor the predetermined frequency used by the portable and fixed transmitters. They decode transmitter signals, validate the transmission for proper format, sample the strength of validated signals and set a normal/off-normal bit flag depending on the information received. A decoded transmission, assuming it is in the proper format, is stored by microcontroller 84 in a data register, including the received signal strength, the identification number of the portable transmitter and the state of the normal/off-normal flag bit.

Figure 5:
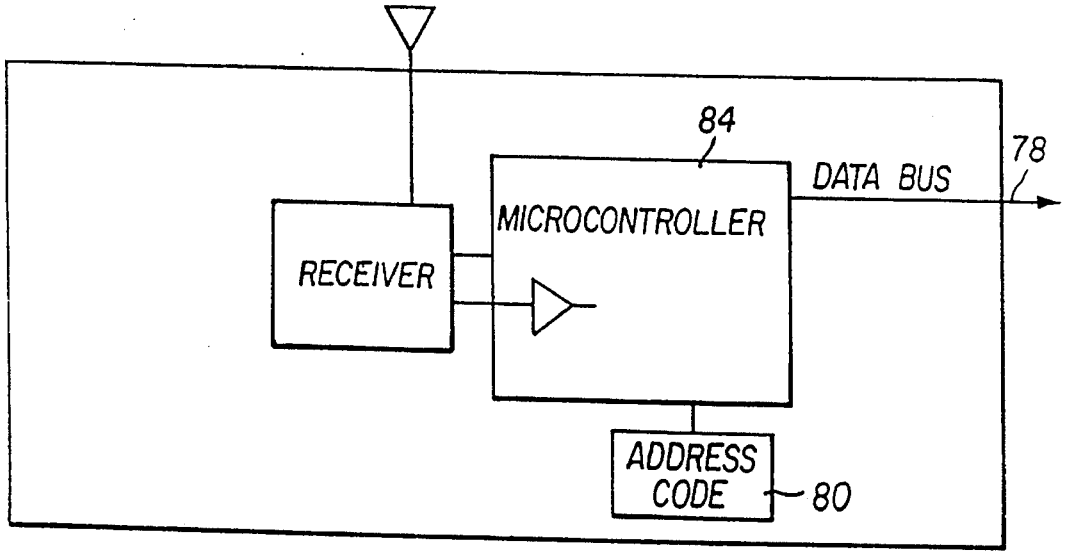
FIG. 5 is a schematic representation of a receiver for decoding signals from the transmitter of FIG. 3, and providing an output signal identifying the transmitter codes, the received signal strength and the identity of the receiver.

The receivers communicate with their associated transponder 30 through a bus 78 (FIG. 1). The transponder queries each receiver using a unique identification or address code 80 (FIG. 5) associated with each receiver. If the flag bit is normal, the transponder continues with queries cycled to other receivers. If the flag bit is off-normal, indicating, for example, either an alarm or a test, the transponder requests the stored information. This includes the reason for the off-normal condition, e.g. alarm or test, the strength of the received signal and the unique identification code of the sending transmitter. The transponder also associates the retrieved transmitter and signal information with the identification code of the receiver holding the information.

Several receivers preferably will receive, store and transfer information connected with a single alarm or test. This information is handled slightly differently, depending on the class code associated with the transmitter. As mentioned above, the class code identifies the transmitter assignment to a subscriber or to security personnel.

Subscriber Alarm or Test

If the alarm or test is initiated by a subscriber, as determined by the class code, the transponder compares the received signals, selects the eight strongest, and sends the information, including received signal strength, transmitter identification, and receiver identification, on to the control station. The control station makes a similar comparison with information that might be received from other transponders and displays on a screen the location of the receivers of the strongest signals.

If the off-normal condition is caused by a subscriber alarm, the transponder immediately actuates a local horn in the receivers of the signal. The control station then checks the signal information against its records, particularly the transmitter identification. Assuming here that the check is positive, the transponder and control station then issue commands activating the sounder and strobe closest to the eight above-mentioned receivers. If the off-normal condition is caused by a subscriber test, the control station will use the unique identification of the portable transmitter to look in its records for an active subscriber, and will indicate the results of the test by energizing a green or red light emitting diode (LED, not shown) on the eight receivers. The red LED might be actuated, for example, to indicate an expired subscription, while the green LED would indicate a successful subscriber test.

Security Alarm or Test

An alarm or test initiated by security personnel, again as determined by the class code, starts essentially the same as a subscriber alarm or test. The transponder compares the signal strength to other received signals and sends the information, with the transmitter and receiver identifications, to the control station. If the off normal condition is caused by a security alarm, the control station compares the information that might be received from other transponders and displays on a screen the location of the receivers of the strongest signals. Alarms and strobes might be initiated just like a subscriber alarm, or an alternative mode might be implemented that summons assistance in a silent mode without audible or visible alarms.

If the off-normal condition is a test by security personnel, the control station determines if the received signal strength exceeds a predetermined threshold, at or near the highest end of its potential range, indicating a transmission from a position close to the receiver. Such a strong test signal from a security assigned transmitter initiates the guard tour or security surveillance features at the control station. The time, transmitter identification and receiver location all are recorded to provide information for monitoring the tour or other surveillance. The control station also monitors expected guard transmissions against a predetermined schedule, and issues a notification when the transmissions are late or otherwise differ from expectations.

Control Station

Control station 16 (FIG. 1) includes a transceiver 88, monitor 90, and computer 92. The control station communicates with the transponders 30 and 32 for controlling the sounders and strobes 34 and 36 in the alarm state, the red and green LEDs in the subscriber test state, and the guard tour features in the security test state. The control station also is used for entering system information and parameters. It might include a map of the protected area and a program for showing the locations of receivers in the vicinity of an alarm or test transmission. Typically, the control station will store subscriber records including active or inactive status, identification of the portable transmitter assigned to each subscriber, and the times and locations from which it was used, either in an emergency or for a test.

Transponder Operation

Figure 7:
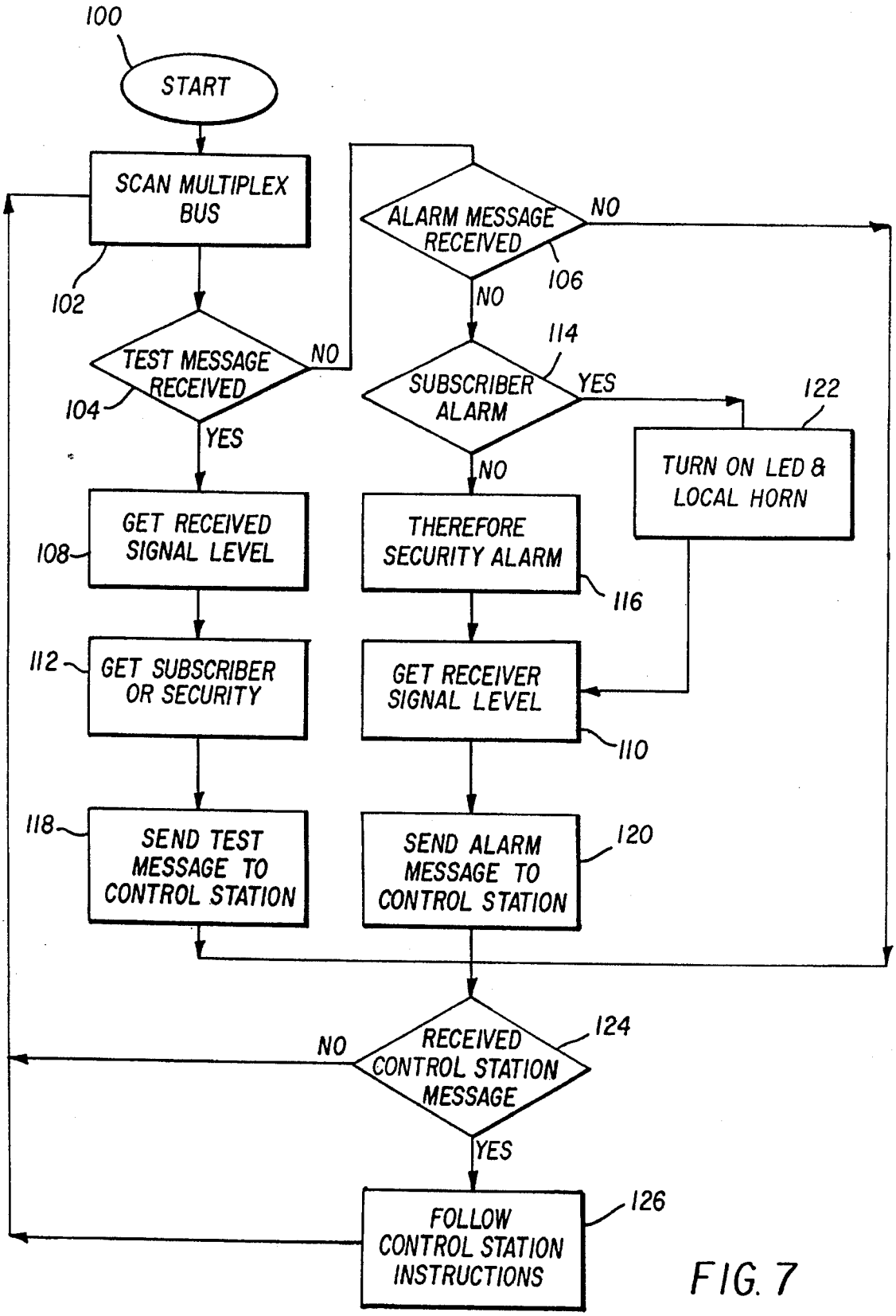
FIG. 7 is a flow diagram representing the operation of the preferred transponder of FIG. 1.

Referring now primarily to FIG. 7, the operation of transponder 30 (FIG. 1) is depicted in a flow diagram. Starting at 100, the transponder scans the bus 78 (FIG. 1) for an off-normal receiver flag, box 102. If all flags are normal, it continues to scan the bus. If a flag is off-normal, the transponder requests information from the off-normal receiver(s), including the reason for the off-normal flag, decisions 104 and 106, the received signal strength, boxes 108 and 110, and the class to which the transmitter was assigned, boxes 112, 114 and 116. The requested information is then sent to the control station, boxes 118 and 120, along with the identification of the receiver(s) of the transmission. If the transmission was a subscriber alarm, the transceiver activates a local horn and LED, box 122. Otherwise, any sight or sound alarm waits for direction from the central station. The operation of the control station will be described in connection with FIGS. 8A and 8B. It is noted here, however, that the transponder may receive and carry out instruction from the control station, as indicated at decision 124 and box 126. These instructions relate primarily to actuation of the sounder and strobe 34 (FIG. 1).

Control Station Operation

Figure 8A:
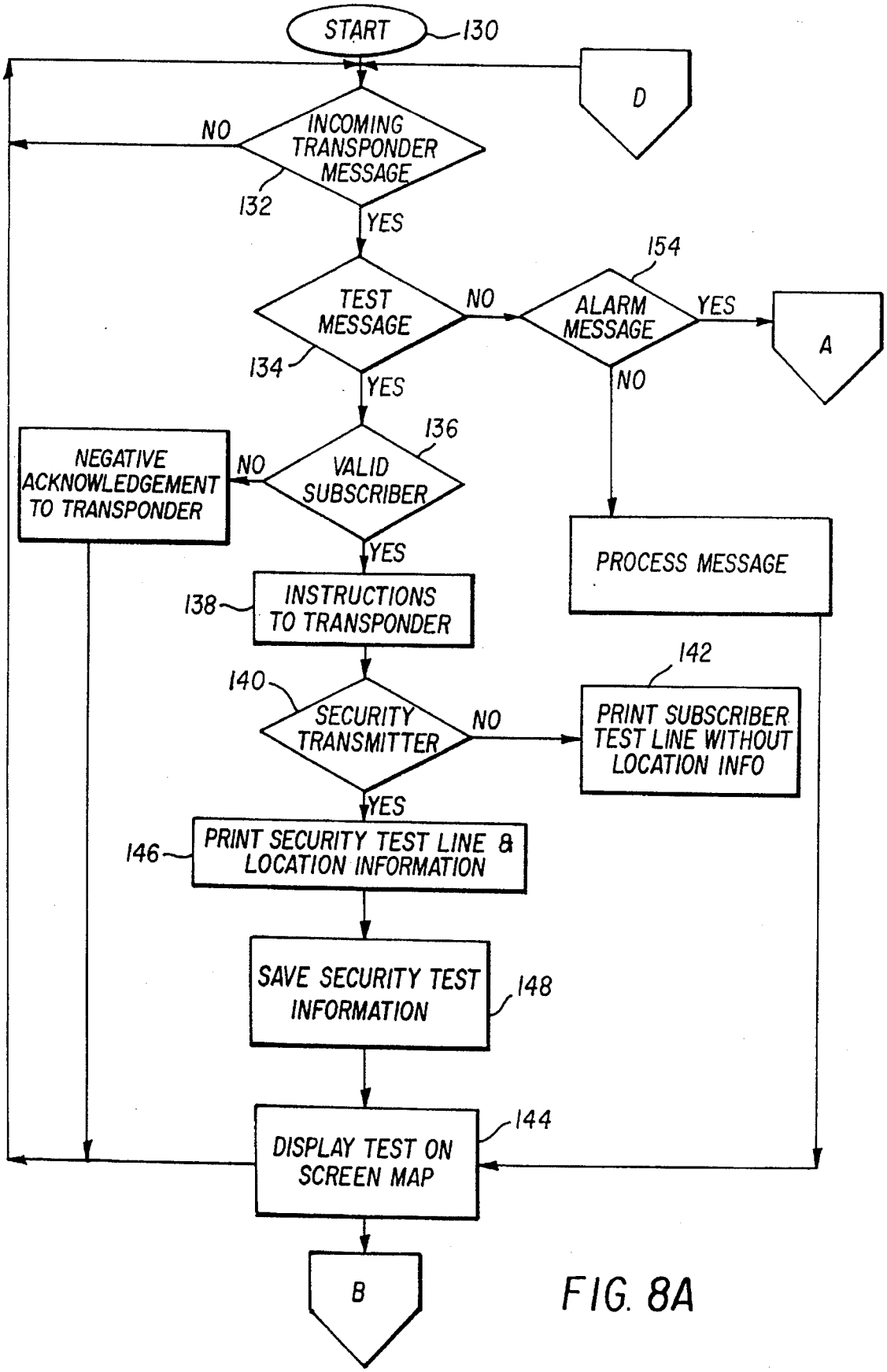
FIGS. 8A and 8B are sections of a flow diagram representing the operation of the preferred control station of FIG. 1.
Figure 8B:
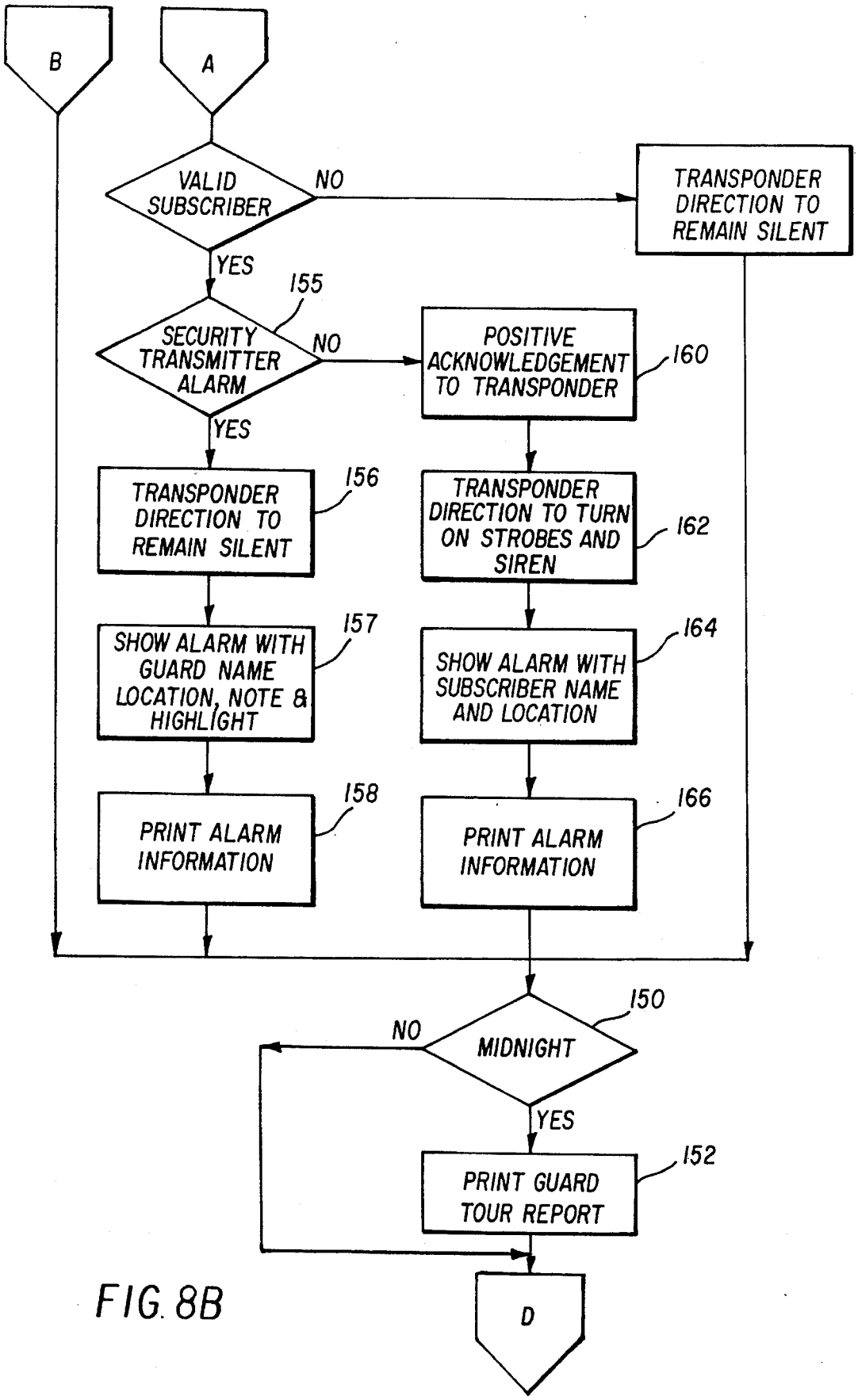

The operation of control station 16 (FIG. 1) is described here with reference primarily to the flow diagram of FIGS. 8A and 8B. From the start at 130, the control station watches for incoming transponder messages, decision 132. If it receives a test message, decision 134, the control station checks its records for a valid subscriber, decision 136, and sends appropriate instructions to the transponder, box 138. In the case of a subscriber test, for example, the control station directs the transponder to activate a local LED indicating the results of the test. The control station then prepares, saves, and prints or displays information depending of the class code. For a subscriber test, the time of the transmission and the identity of the tester are saved, printed and displayed, boxes 142 and 144, but not the location information. If the test is by security personnel, on the other hand, the location information is saved, printed and displayed, boxes 146, 148 and 144, as well as the transmission time and transmitter identity. This information is used for monitoring guard tours and similar security surveillance. Alarms may be sounded or notices displayed at the control station if a guard is overdue at an expected location. At the end of the day, a report is printed outlining the results of the monitoring, decision 150 and box 152 (FIG. 8B).

An alarm message follows decision path 154 (FIG. 8A). If it is an alarm from a transmitter assigned to security personnel, decision 155 (FIG. 8B), the control station completes events 156, 157 and 158, directing the transponder to remain silent, but displaying at the control station the guard's location and identification. If the alarm is not from a security assigned transmitter, it is a subscriber alarm, and the transponder is directed to initiate the strobes and sounders in the vicinity of the transmission, boxes 160 and 162. The identity of the subscriber also is displayed, boxes 164 and 166.

It should now be apparent that a personal security system is provided that includes many unique and advantageous features including those summarized at the introduction to this specification.

While the invention is described in connection with a preferred embodiment, other modifications and applications will occur to those skilled in the art. The claims should be interpreted to fairly cover all such modifications and applications within the true spirit and scope of the invention.

What is claimed is:

1. A personal security system comprising:

a plurality of hand-portable devices for transmitting radio frequency signals, said signals including a code identifying first and second sets of said hand-portable devices, respectively;

a plurality of fixed devices for receiving said radio frequency signals, said fixed devices 1) decoding said signals to identify said first and second sets, respectively, and 2) registering the strengths of the received signals; and, means using only a strongest of the received signals for locating a respective hand-portable device in said first set and using the received signals at a plurality of said fixed devices for locating a respective hand-portable device in said second set.

2. The invention of claim 1, wherein said locating means records time of day when said hand-portable devices in said first set transmit said signals.

3. A personal security system for use by subscribers and security personnel, said system comprising:

a plurality of transmitters assigned to said subscribers and said security personnel, each of said transmitters including means for transmitting a radio frequency signal including a code uniquely identifying the respective transmitter;

a plurality of fixed devices in predetermined locations, each fixed device including means for receiving and decoding the signals from said transmitters and for recording the strengths of the received signals;

means for identifying the fixed devices receiving said signals to locate said transmitters of said signals; and, means using said unique codes for differentiating between said transmitters assigned to said subscribers and said transmitters assigned to said security personnel, said last mentioned means a) locating respective ones of said transmitters assigned to subscribers using said recorded signal strengths at multiple said fixed devices and b) locating respective ones of said transmitters assigned to security personnel using said recorded signal strengths to identify a single said fixed device.

4. The invention of claim 3, wherein said differentiating means adds said location of transmitters assigned to security personnel to a guard tour record.

* * * * *